US008622050B2

(12) United States Patent
Goff et al.

(10) Patent No.: US 8,622,050 B2
(45) Date of Patent: Jan. 7, 2014

(54) LINE CROSSBOW CONVERSION KIT AND HYBRID COMPOUND BOW

(76) Inventors: Jerry Goff, Saucier, MS (US); Sherwood L. Goff, Saucier, MS (US)

( * ) Notice: Subject to any disclaimer, the term of this patent is extended or adjusted under 35 U.S.C. 154(b) by 286 days.

(21) Appl. No.: 13/117,666

(22) Filed: May 27, 2011

(65) Prior Publication Data

US 2011/0303205 A1 Dec. 15, 2011

Related U.S. Application Data

(60) Provisional application No. 61/354,818, filed on Jun. 15, 2010.

(51) Int. Cl.
*F41B 5/12* (2006.01)

(52) U.S. Cl.
USPC ..... 124/25; 124/25.6; 124/35.2

(58) Field of Classification Search
USPC ..... 124/23.1, 24.1, 25.6, 35.2, 86, 88, 40, 124/25
See application file for complete search history.

(56) References Cited

U.S. PATENT DOCUMENTS

| | | | | |
|---|---|---|---|---|
| 1,526,176 | A * | 2/1925 | O'Connell | 124/24.1 |
| 2,982,279 | A * | 5/1961 | Pursley | 124/35.1 |
| 4,603,676 | A * | 8/1986 | Luoma | 124/25 |
| 5,085,200 | A * | 2/1992 | Horton-Corcoran et al. | 124/25 |
| 5,156,138 | A | 10/1992 | Grover | |
| 5,161,514 | A | 11/1992 | Cary | |
| 5,205,267 | A | 4/1993 | Burdick | |
| 5,390,654 | A | 2/1995 | Perkins | |
| 5,465,705 | A | 11/1995 | Baeseman | |
| 5,490,492 | A | 2/1996 | Savage | |
| 5,671,723 | A | 9/1997 | Goff | |
| 5,944,004 | A | 8/1999 | Goff | |
| 6,968,836 | B1 * | 11/2005 | Kees | 124/35.2 |
| 7,607,423 | B1 * | 10/2009 | Kees et al. | 124/35.2 |
| 7,708,001 | B2 | 5/2010 | Kempf | |
| 7,779,824 | B2 | 8/2010 | Bednar | |
| 2008/0202487 | A1 | 8/2008 | Maleski | |
| 2009/0114200 | A1 | 5/2009 | Giroux | |
| 2010/0116259 | A1 | 5/2010 | Popov et al. | |

* cited by examiner

*Primary Examiner* — John Ricci
(74) *Attorney, Agent, or Firm* — Drinker Biddle & Reath LLP

(57) ABSTRACT

A kit is provided to convert a compound archery bow into a left or right handed inline (vertical limb) crossbow. The conversion kit includes a mounting plate attachable to a side of the bow riser section to hold a socket to receive a draw-lock bar which can be removed for take-down and storage. The draw-lock bar has a series of laterally spaced bolt holes to attach a grip with a trigger release latch assembly at a selectable draw length. The bar can be rotated and attached to either side of the bow, and the trigger and grip can be reposition within the trigger housing for left, right or horizontal shooting. The string latch assembly has an anti-dryfire lever that is only moved from the blocking position when an arrow is nocked. The kit also provides a hinged cocking stirrup, and a front hand vertical grip on the riser side opposite the draw-bar socket. Also disclosed is a dedicated hybrid compound bow for dedicated use with kit as an inline or traditional crossbow. The hybrid compound bow is made especially. The hybrid bow has no forehand grip, and has a shoot through riser to provide vertical and horizontal centering of the arrow to the string.

11 Claims, 9 Drawing Sheets

LINE CROSSBOW CONVERSION KIT AND HYBRID COMPOUND BOW

RELATED APPLICATIONS

This application claims the benefit of U.S. Provisional Patent Application No. 61/354,818 filed Jun. 15, 2010.

BACKGROUND OF THE INVENTION

The present invention relates to the general classification of archery bows, and more particularly to cross bows and vertical bows operated with draw-locking and release features.

Bow hunters strive for high speed/flat trajectory and deep penetration energy when using either compound bows or crossbows, but each type of bow produces its arrow's flight energy in a different manner. A compound bow typically has a lower maximum draw weight (e.g., 50-80 lbs, with a 50% or greater drop-off at full draw), but a longer power stroke (e.g. 18-24 inches) than the crossbow—which by comparison typically has a high draw weight (150-225 lbs) but a short power stroke (10-14 inches). These differences produce commensurate differences in arrow/bolt speed and penetration. For example, a 70 lb pull compound bow will typically launch an arrow at a higher velocity than a 150 lb crossbow does with its shorter and lighter bolt.

Power stroke is the distance the bow string travels from full draw to the rest position. For example, a compound bow with a 30 inch draw length and a 7 inch brace height (distance from grip to the string at rest) has a 23 inch power stroke (30−7+23). A person using a 30 inch draw will shoot the same weight arrow faster than one using the same draw weight and arrow with a 28 inch power stroke. The same relationship exists with the crossbow—longer power stroke causes higher velocity.

The power stroke and draw weight variations have other effects beyond speed and energy. The most noticeable effect of the draw weight is the effort and techniques used to draw the bow. The heavy draw weight of the cross bow usually requires two-handed cocking using leg and back muscles to draw the string against a foot stirrup or bar. Some archers may not have enough strength for even that two-handed maneuver, and must rely upon a mechanical crank. This effectively limits a crossbow hunter to a single shot at game, since it is cumbersome to re-cock the cross bow and nock a bolt in a tree stand or cramped blind. On the other hand, a hunter can hold the loaded crossbow on an approaching target for an extended time while waiting for the range and cover to present an opportunity for a lethal shot, since there is no draw weight acting against the archer's muscles. De-cocking the crossbow is another difficult task, and many find it more convenient to simply fire the bolt into soft ground to de-cock.

The compound bow is the more accurate weapon in the hands of an experienced archer because of its consistent anchoring point when using string loop and mechanical release, which defines the nock point more consistently than does the crossbow latch, but the crossbow allows much faster mastery by beginners, as its aiming and trigger systems closely resemble a shoulder mounted firearm. The crossbow is also heavier than a compound bow, and less maneuverable in brush or tree branches.

Considering that the main advantage of the crossbow is its ability to draw and lock it at full draw until ready to shoot, it is not surprising that innovators have devised mechanisms to lock a compound bow at full draw. A representative example of these draw-locking mechanisms is shown in U.S. Pat. No. 5,671,723 by the present inventor.

SUMMARY OF THE INVENTION

Even after the advent of draw-locking devices, there is still a place for a kit to convert a compound bow into a configuration that can be aimed and fired like a cross-bow, and then disassembled to allow the bow to be used in a traditional fashion. This invention provides components of a kit for this purpose.

Moreover, the invention also provides a hybrid compound bow for use with the kit as a dedicated crossbow. Consequently, there are two different aspects of this invention: (1) a kit for converting a compound bow into a left or right handed inline crossbow, and (2) a dedicated hybrid compound bow to use with the kit that eliminates or modifies some features of the traditional compound bow, and which can be mounted to the conversion kit as an inline crossbow or a traditional horizontal limb crossbow.

The conversion kit of the invention provides a draw-lock bar that simulates a forearm stock, having a pistol grip and trigger-actuated string release at the butt end. The trigger has a regular cross bar safety. An additional anti-dryfire lever stops the string latch from releasing the string loop when there is no arrow nocked, even if the safety is off and the trigger is accidently pulled.

The draw-lock bar mounts into a receiver socket that is attached at an adjustable angle to a mounting plate at the compound bow's arrow rest screw taps. The bar can be quickly detached from the receiver socket to break down the bow/kit into two parts for compact storage The bar can also be hinged in the middle to fold in half for storage. The bar is a hollow tube with square cross section, and has a series of holes spaced along its length to adjust the draw length. A compound bow can be mounted to the draw-lock bar in either right hand or left hand inline (vertical limbs) configuration, and the hybrid compound bow can be mounted as an inline or traditional crossbow (horizontal limbs) configuration.

The kit also provides a cocking stirrup attached to the draw-lock mounting plate in front of the draw lock socket. The stirrup has a pivoting hinge connection to the mounting plate so that the stirrup can be folded back 180 degrees to lie along the outside edge of the bar. When using the hybrid crossbow (horizontal limb) configuration the stirrup can also be stopped at a 90 degree position under the bar and used as a bipod rest, or stopped at 45 degrees under the bar as a kick-stand supporting the bow with the arrowhead angled upward. The kit also includes a vertical hand grip attached to the bow riser on the opposite side from the bar socket.

The hybrid compound bow of the invention is made specifically for use with the conversion kit. It has forward curving riser sections that locate the limb pockets well in front of the riser center point. The limbs extend backward from the pockets in an essentially parallel or slightly closing orientation, such that the axle to axle distance between the eccentric pulley wheels is very short, on the order of 18-19 inches. This provides a very compact compound bow with a power stroke that can be over 20 inches, depending of the draw bar length selected. With the aid of the cocking stirrup, even a 75-80 lb draw weight is easily handled by almost any adult. The hybrid bow does not itself have a handgrip, and thus is not a stand alone bow. The forward handle is provided by the vertical grip of the conversion kit. The lack of an integral handle, however, allows the bow to use a shoot-through riser with a contained arrow rest (such as a whisker biscuit) that locates the arrow exactly on vertical and horizontal center from the nocking point through the center cut-out in the biscuit. This exact centering improves accuracy by reducing arrow torque and string vibration, and is the most efficient location (the center) of the string for top speed and performance.

The invention will be described below with reference to the conversion kit in combination with the hybrid bow. It should be apparent from this description how it can be used to convert a traditional compound bow in a similar manner, although some explanation of the differences will be provided at times where appropriate.

These and other features, aspects and advantages of the present invention will become better understood with reference to the following drawings, description and claims.

DETAILED DESCRIPTION OF THE INVENTION

Figure 1:
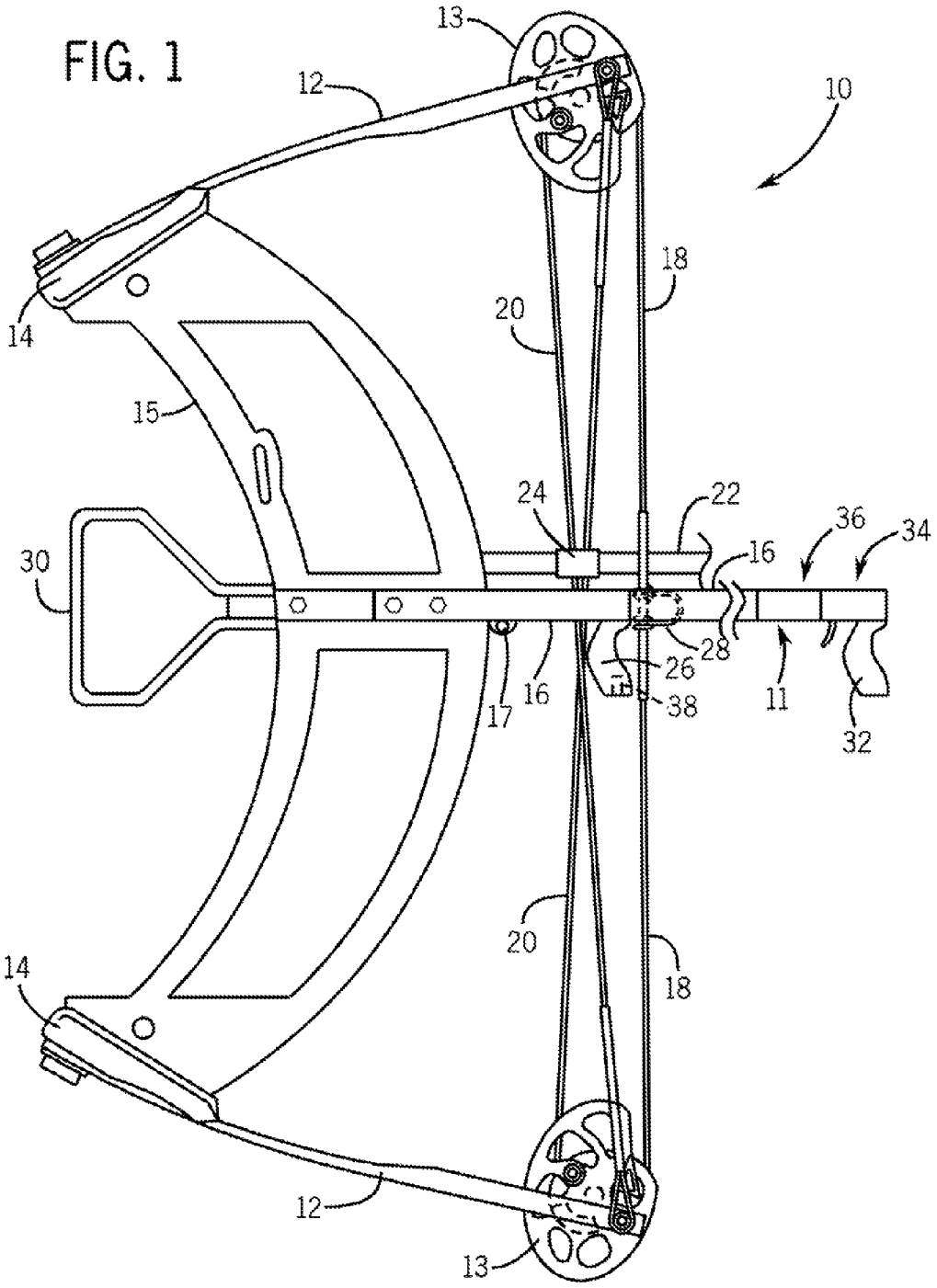
FIG. 1 is a left side elevation view of a hybrid archery bow mounted on the draw-lock bar of a conversion kit for right-handed inline shooting in accordance with the invention. The front-end vertical grip of the kit is not shown in this drawing.
Figure 2:
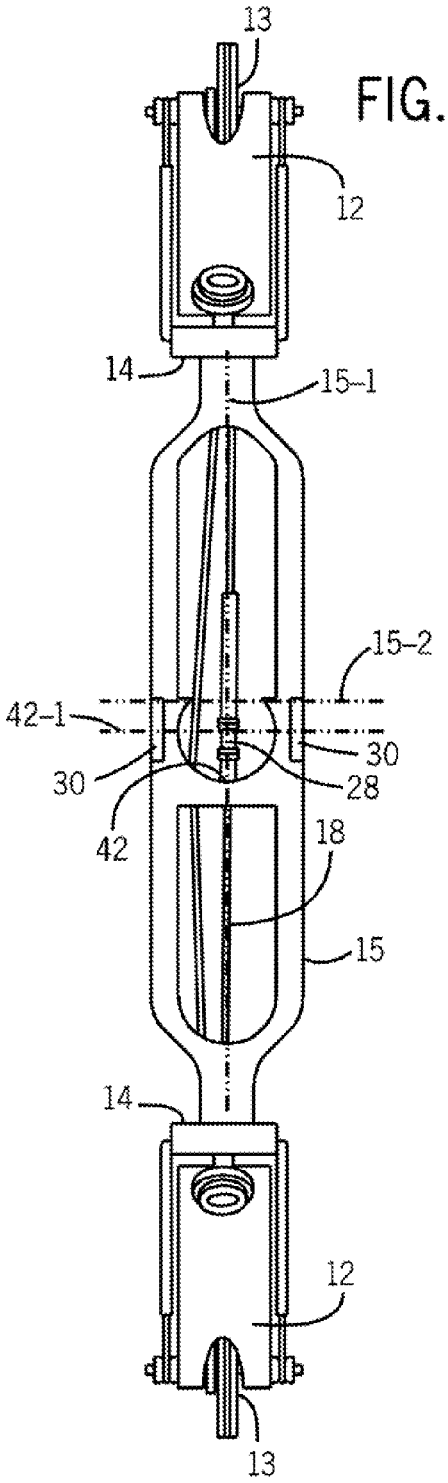
FIG. 2 is a front elevation view of the riser section of a hybrid bow as in FIG. 1 without being mounted on the conversion kit.
Figure 3:
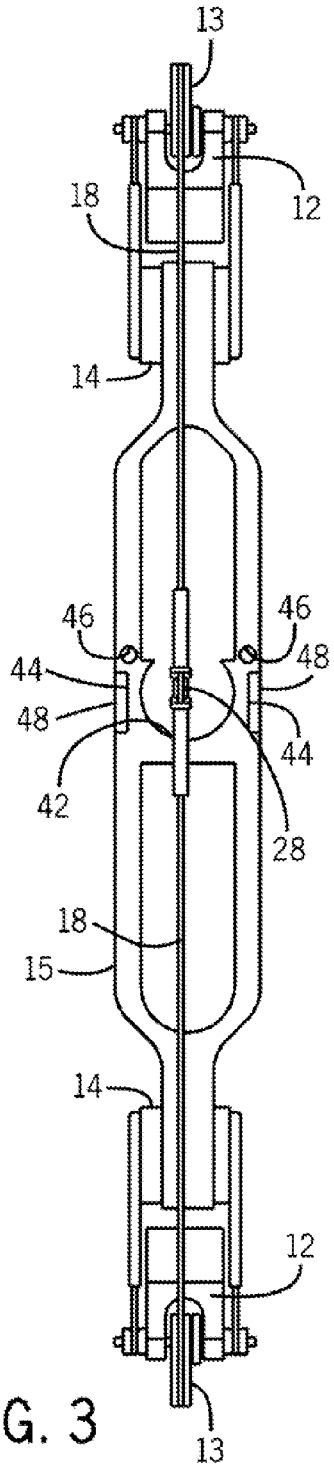
FIG. 3 is a rear elevation view of the riser section of a hybrid bow as in FIG. 2.

The following description is of exemplary embodiments of the invention. The scope of the invention is defined by the appended claims. Various features are described that can be used independently of one another or in combination with other features.

As stated earlier, the invention will be described below with reference to the conversion kit in combination with the hybrid bow. It should be apparent from this description that the same kit can be used to convert a traditional compound bow in a similar manner, although an explanation of the differences will be provided at times where appropriate. Both the hybrid bow and a traditional compound bow can be mounted to the draw-lock bar with limbs oriented vertically in either a left or right hand configuration. The hybrid bow can additionally be mounted to the draw-lock bar with limbs oriented horizontally (traditional crossbow orientation).

The following is a legend that may assist in identifying number items in the drawings.

DESCRIPTION LIST

10: is the overall conversion kit and hybrid compound combination.
11. is the hybrid bow
12: are the bow limbs.
13: are the eccentric pulleys.
14: are the limb pockets.
15: is the upper riser section
16: is the draw-lock bar.
18: is the bow string.
20: are the cables.
22: is the cable guard.
24: is the cable slide.
26: is the forehand grip.
28: is the bow string draw loop.
30: is the foot cocking stirrup.
31: are the foot stirrup mounting bolts.
32: is the pistol grip.
34: is the trigger section.
36: is the string latch section.
38: is a threaded hole for attachments.
40: are the stirrup bolts to mounting plate 71.
42: is an arrow rest shelf.
44: are the grooves for mounting plate 71, holding the draw-lock bar socket 48 and the foot stirrup 30.
46: are mounting holes for the cable guard 22.
48: is the draw-lock bar receiving socket.
50: are the angle adjustment bolts for socket 48.
52: is the trigger.
54: is the safety.
56: is the trigger spring.
58: is the trigger pin.
60: is the trigger latch.
61. is the trigger latch roller.
62: is the anti-dryfire lever.
64: is the break-down hinge of the draw-lock bar.
66: is an optional draw-lock bar.
68: is the an optional butt stock.
70: is an optional forearm stock.
71: is an angle-adjustment mounting plate.

FIGS. 1 through 4 show the combination 10 of a hybrid bow and conversion kit 11 to make it useable as an inline crossbow or a traditional crossbow, depending upon the limb orientation. The hybrid bow is specifically adapted for use with this conversion kit. It has most of the features of a traditional compound bow, such as limbs 12 extending from adjustable angle limb pockets 14 to tips with eccentric cable pulleys 13. The bow has forward curving riser sections (15 is the combined upper and lower sections of the riser) that locate the limb pockets well in front of the risers' center point. The limbs extend back from the pockets in an essentially parallel or slightly closing orientation, such that the axle to axle distance between the eccentric pulley wheels is very short, on the order of 18-19 inches at rest. This provides a very compact compound bow, but with a power stroke that can still be over 20 inches, depending of the draw length selected with the conversion kit. The hybrid bow also has other normal compound bow elements, such as a bow string 18 (including a draw loop 28) attached to cables 20, a cable guard 22 and a cable slide 24.

Because it is specifically designed for use with the conversion kit, the hybrid bow's riser 15 is a shoot-through riser 15 where the riser sections are split to allow the arrow to pass through the riser rather than along a side of it. This split riser configuration is well known and found on several traditional compound bows. The riser has a circular cut-out for a contained type of arrow rest that envelops and constrains the arrow centered on the rest even when the bow is canted, such as the Whisker Biscuit by Trophy Ridge Archery or the Catawba Still Shot rest. This cutout places the arrow slot in the rest at the horizontal centerline of the riser, and thus allows the alignment of the flocking point on the string with the center of the arrow rest to position the arrow in the plane of the horizontal centerline of the bow. This allows the string 18 to be approximately aligned with the vertical center line 15-1 (see FIG. 2) and the horizontal center of the riser. Thus, the arrow has both vertical and horizontal centering on the bow, whether the limbs are positioned vertically or horizontally.

Note that the hybrid bow does not have a forehand grip at the riser. This hybrid bow is dedicated to be used with the conversion kit, which supplies a vertical forehand grip 26 to be attached on the side opposite to the draw-lock bar assembly to accommodate right or left hand shooting.

Figure 4:
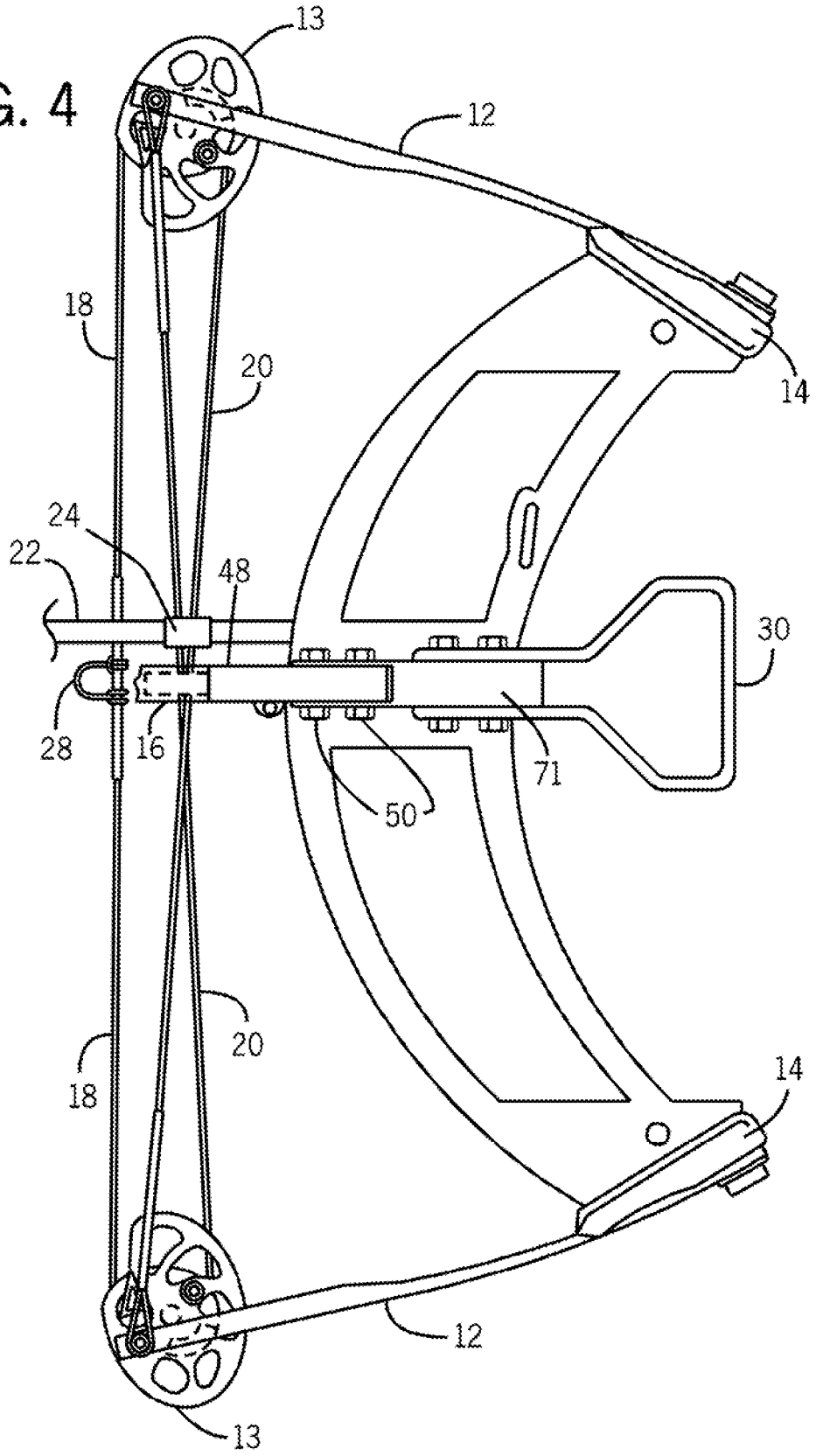
FIG. 4 is a right side elevation view of the hybrid bow mounted to a conversion as in FIG. 1.

Both sides of the riser on the hybrid bow have a mounting plate 44 for mounting elements of the conversion kit to the bow. As shown in FIG. 13, the mounting plates can be made integral into the hybrid bow, or can be separate plates supplied in the kit to be used with a traditional compound bow. As shown in FIG. 4, when configured for right hand shooting, a square-profile hollow tube socket 48 is attached to the right side mounting plate 71 by bolts 50. The socket 48 receives the distal end of the draw-lock bar 16. The socket can be attached to the mounting plate at an adjustable angle by the bolts 50 passing through a fixed hole and an elongated slot, as shown in FIG. 11.

Figure 11:
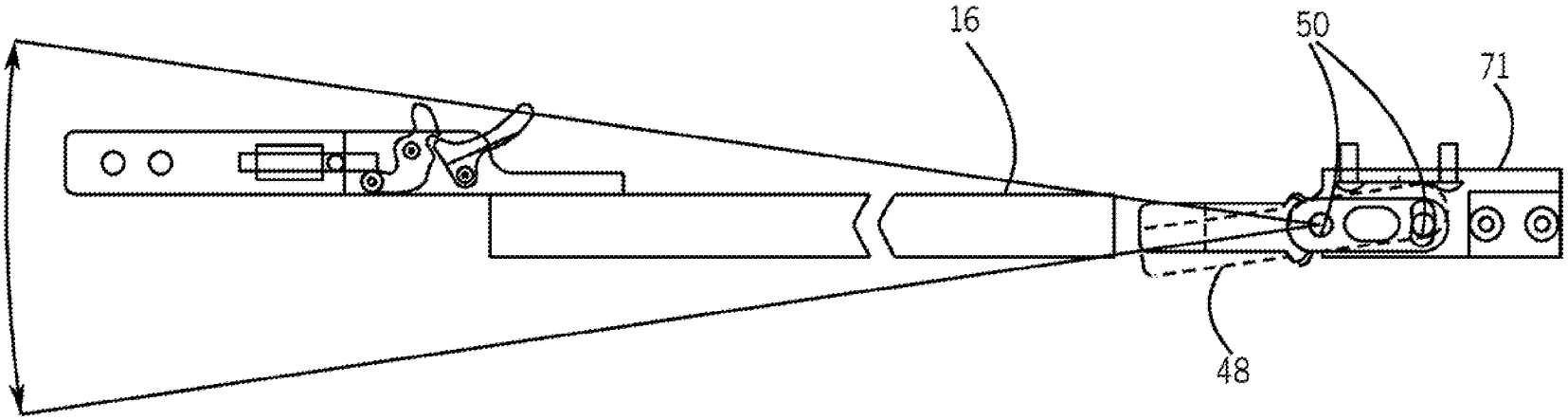
FIG. 11 is a side elevation view of the mounting plate for use with a conventional compound bow.

The mounting plates for a traditional compound bow are shown in FIG. 11. The mounting plate to which the draw-lock socket is attached has a bolt hole and a bolt slot. The slot allows the socket to be adjusted to set the bar at a small angle set-off from the bow centerline so that it does not interfere with the cables and draw string. By making this offset angle with the socket, there is no need to bend the bar. The bar remains straight no matter whether it is mounted on the left or right side of the bow.

Figure 9:
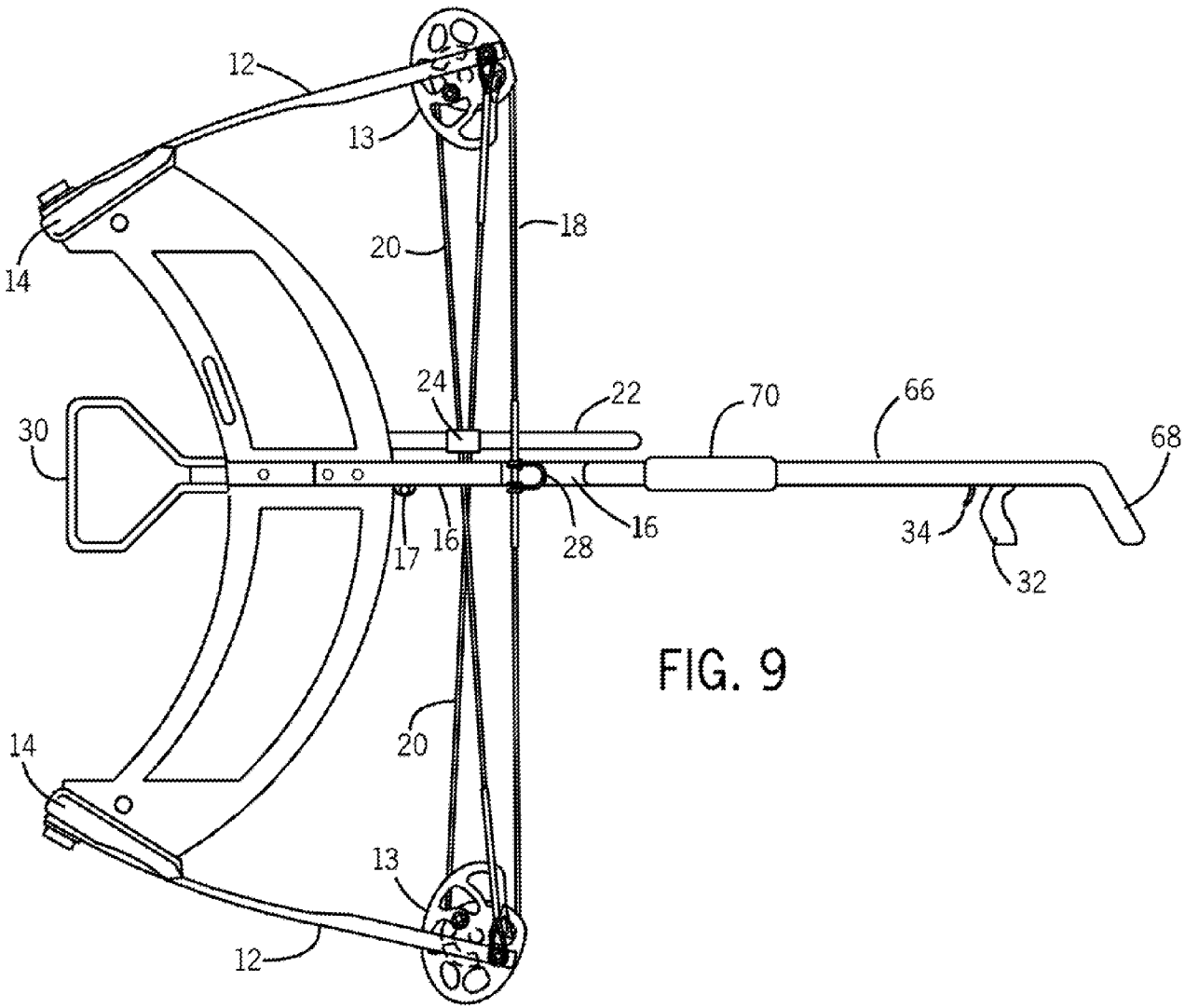
FIG. 9 is a left side elevation view of a hybrid archery bow hybrid archery bow mounted on a alternative conversion kit, wherein the draw-lock bar includes a butt stock and a forearm stock.
Figure 10:
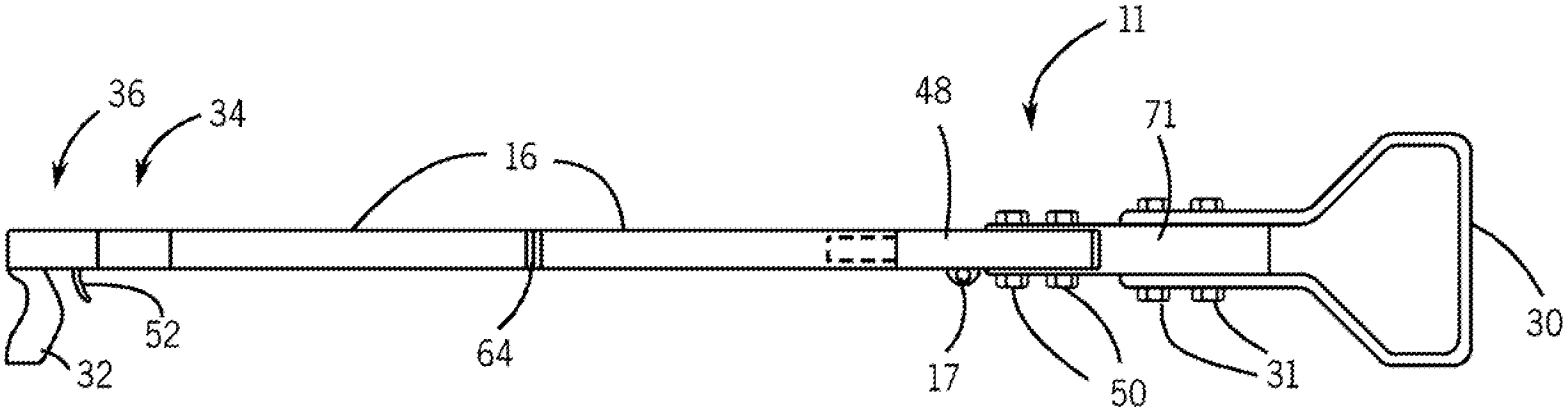
FIG. 10 is a side elevation view of the draw-lock bar showing the angle adjustment mounting bolts that attach the adjustable mounting plates.

The draw-lock bar 16 that is inserted into the socket 48 simulates a forearm stock, having a pistol grip and trigger-actuated string release at the butt end. The trigger assembly has a regular crossbar safety 54 behind the trigger 52, and an anti-dryfire lever 62 that stops the string release latch 60 from moving enough to release the string loop if there is no arrow on the string, even if the trigger is accidently pulled. The draw bar can optionally be extended to terminate in a butt stock 68 for shoulder mounting (as shown in FIG. 9), but since the bow does not produce a rearward recoil to be absorbed by the shoulder, there is no need for any shoulder contact.

Figure 5:
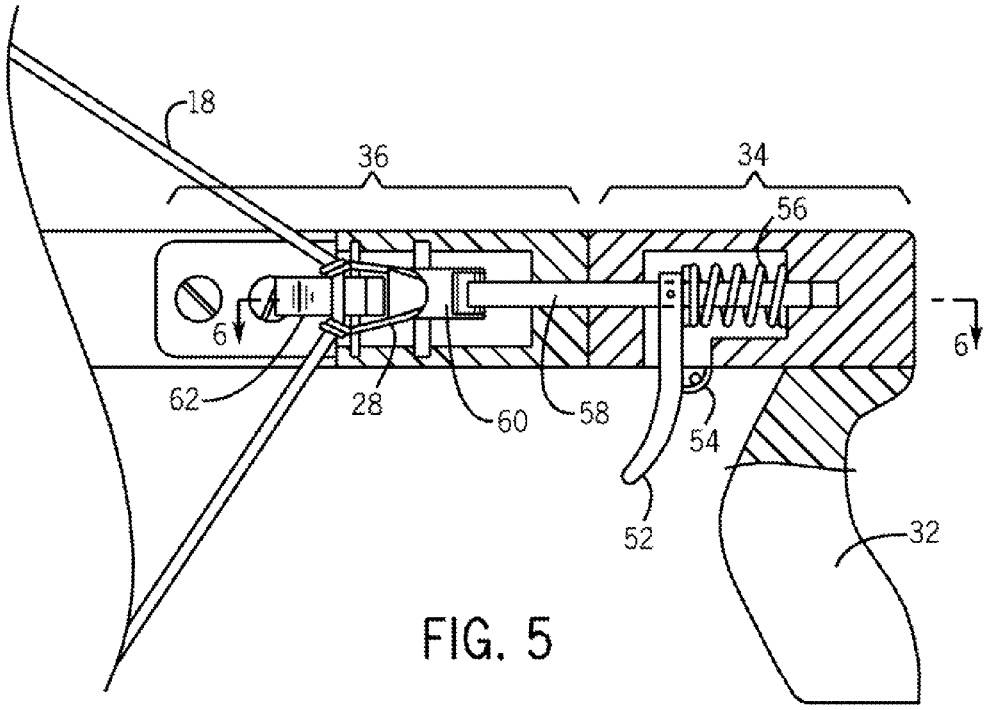
FIG. 5 is a right side elevation view of the string latch and release assembly of the conversion kit, with parts broken away along the housing and pistol grip to view the string release and trigger mechanism.
Figure 6:
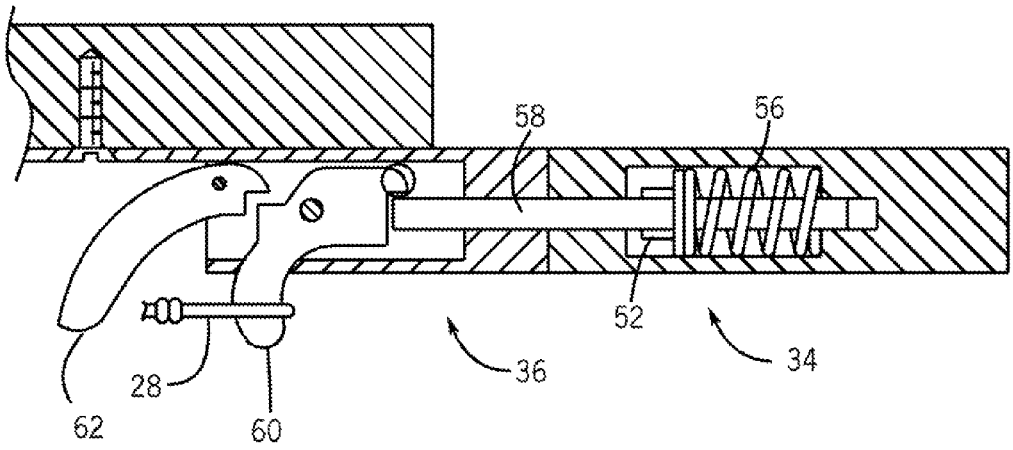
FIG. 6 is a top cross-sectional view taken on line 6-6 of FIG. 5 to show the string latch, anti-dryfire lever, and trigger mechanism.
Figure 7:
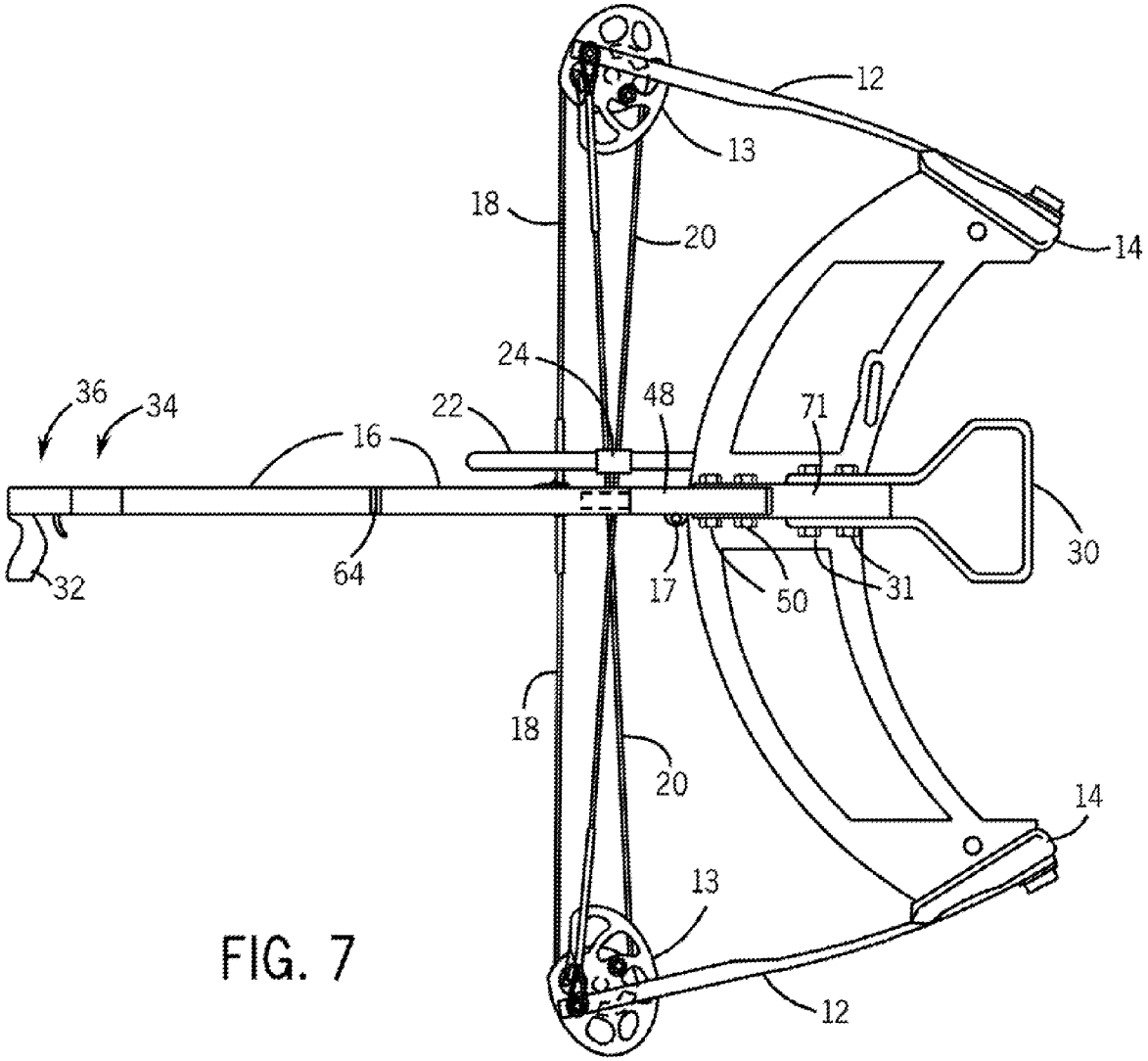
FIG. 7 is a right side elevation view of the hybrid archery bow archery bow mounted on an alternative draw-lock bar, similar to FIG. 4, except having a hinge at the mid-point of the draw-lock bar for breakdown and storage.
Figure 8:
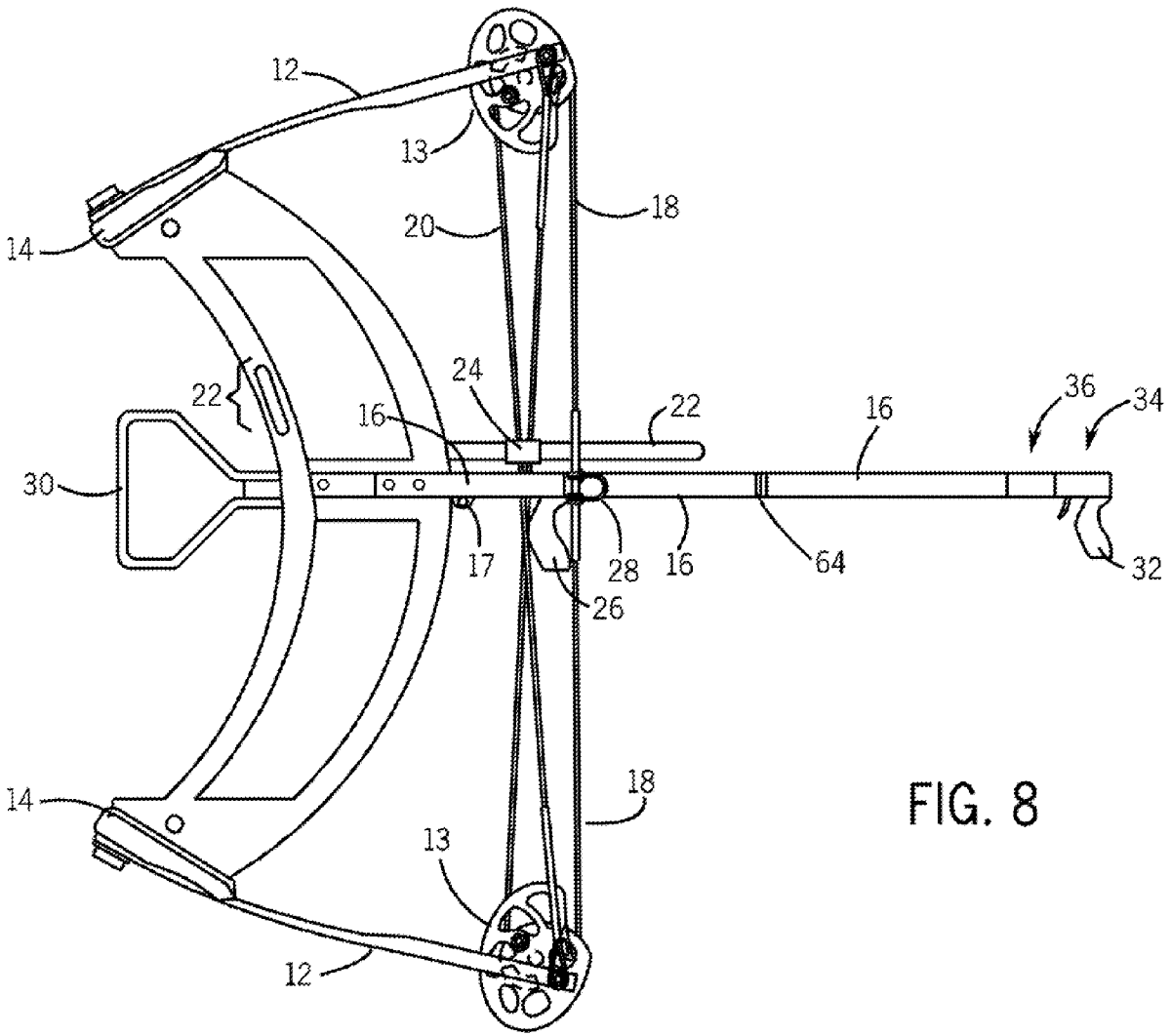
FIG. 8 is a left side elevation view of the hybrid archery mounted on a draw-lock bar as in FIG. 7.

The draw lock bar 16 has a series of bolt holes 36 at least near the trigger grip end that are spaced at about one inch between centers. These holes are used to attach the grip and trigger assembly to the bar at a selected length to adjust the distance between the string latch and the bow string at rest (adjusting draw length). The string latch is part of the pistol grip and trigger assembly (as shown in FIGS. 5 and 6), which comprises a pistol grip 32, a trigger section 34, a safety, a string latch 60, and an anti-dryfire lever 62. The grip and trigger assembly attach to the bar by bolts using the adjustable length draw length holes 36 to select the draw length.

Note that the pistol grip and trigger assembly can be individually located on either side of the draw-lock bar for right or left hand shooting. As shown in FIG. 5, the assembly is always bolted to the inside (side facing the bow string) side of the bar, placing the string latch 60 and anti-dryfire lever in a line with the string and arrow rest. If the bow were configured to be shot left handed, the drawlock bar wound be attached to the mounting plate on the left side of the riser, and the pistol grip and trigger assembly again attached to the inside side of the bar. To place the trigger and grip in the proper downward extending orientation, bolts holding the grip and trigger can be removed, the grip and trigger rotated 180 degrees, and the bolts replaced to hold them in place. Note that the grip and trigger could also be placed in a horizontal position for either left or right handed shooting by only rotating the grip and trigger 90 degrees. Some archers may like this horizontal trigger position. The two trigger bolts can also attach a scope mounting bracket (not shown)

At the front end of the bow, the conversion kit provides a foot stirrup 30 that is attached to the mounting plate 71 on the side having the socket for the draw-lock bar. The stirrup mount is hinged, so that it can be extended in front of the riser for cocking the bow, folded back 180 degree along the bow to be stored out of the way, stopped at 45 degrees as kickstand for resting the bow on the ground or a platform in an inline configuration, or folded 90 degrees downward to act as a bipod shooting rest when using the horizontal limb configuration.

Using his foot in the stirrup, an archer can draw the string with two hands and hook the string release loop 28 over the release latch 60 (See FIGS. 5 and 6). The anti-dryfire lever 62 is a curved piece with a pawl bit formed on one end to engage with a catch on the string release 60. The opposite end of the anti-dryfire lever extends above the draw-lock bar just in front of the release. When an arrow is nocked, the shaft displaces the anti-dryfire level such that the pawl bit can not engage the catch on the string release. When the trigger is actuated, it will allow the string loop to push down the latch. If no arrow is nocked, however, the pawl will engage the catch when the trigger is pulled and hold the release against the pressure of the string loop.

As shown in FIG. 6, the trigger 60 is kept from rotating by a roller release 61 that is blocked from turning by a trigger pin 58. The trigger pin is pushed forward by the trigger spring 56. As the trigger is drawn back against the spring pressure, the pin travels behind the center point of the roller release, and allows the roller to tumble. The tumbling roller allows the string latch to pivot and release the string loop. This gives the sensation of a trigger with a short creep followed by a crisp break. Other types of triggers can be used, however. A conventional crossbar safety 54 is used to prevent accidental firing when an arrow is nocked. When an arrow (not shown) is knocked onto the string, the arrow shaft w displaces the anti dryfire lever from blocking the release latch.

The hunter can mount the hybrid bow 10 by holding the forward vertical grip 26 and the pistol grip 32. When a target is sighted, the hunter can follow its movement with the mounted bow until a good shot opportunity presents, then push the cross bar safety to the firing position, acquire a final sight picture and squeeze the trigger backward against the pressure of the trigger spring 56 until the roller release allows the string latch to rotate and release the string loop.

The conversion kit can also be used to mount the hybrid compound bow to the draw lock bar with its limbs horizontal to the ground like a traditional cross bow. The bow is held in the horizontal orientation when the draw lock bar is inserted into the socket. The trigger and grip can be individually relocated on the trigger assembly for left, right or horizontal shooting by removing the bolts and moving the trigger and grip either 90 degrees or 180 degrees to the appropriate holes and slot. The two grip bolts can be used to attach a scope mounting bracket.

The foregoing description relates to exemplary embodiments of the invention. Modifications may be made without departing from the spirit and scope of the invention as set forth in the following claims.

What is claimed is:

1. A kit for converting a compound archery bow into a vertical limb or horizontal limb crossbow, the kit comprising: a socket to receive a draw-lock bar, the socket being adopted for attachment to a mounting plate located on a side of the bow, a draw-lock bar with one end adapted to be inserted into the socket, and a trigger and string release assembly adapted to be bolted to the opposite end of the draw-lock bar, the trigger and release assembly including a string release section containing a string latch, a trigger section containing a pistol grip and a trigger for actuating the string latch to release the string, and an anti-dryfire mechanism that blocks the string latch from releasing the bow string when the trigger is pulled if there is no arrow nocked onto the string, wherein the blocking mechanism is moved out of the blocking position by the presence of an arrow, and further comprising a foot stirrup attached to the mounting plate to which the socket is attached, the stirrup having a hinged connection to the plate that allows the stirrup to extend forward of the bow in an open hinged position and be folded back along the bow in a closed hinge position.

2. A kit as in claim 1, further comprising the draw-lock bar having at its opposite end a series of laterally spaced bolt holes along its length, and the trigger and release assembly being mounted to the bar at selected bolt holes to establish a power stroke length for the bow.

3. A kit as in claim 1, wherein the draw-lock bar socket can be mounted on a mounting plate located on either left or right hand side of the bow such that the draw lock bar can be mounted either side of the bow, the trigger and string release assembly can be mounted on the inside of the bar when the bar is either on the left or right side of the bow, and the trigger and pistol grip can be individually relocated within the trigger section for right or left hand shooting.

4. A kit as in claim 3, further comprising the draw-lock bar having at its opposite end a series of laterally spaced bolt holes along its length, and the trigger and release assembly being mounted to the bar at selected bolt holes to establish a power stroke length for the bow.

5. The kit of claim 1 further comprising a second mounting plate for attachment to the bow on the side of the bow opposite the drawlock bar socket for mounting a vertical hand grip.

6. The kit of claim 1 further comprising the foot stirrup been capable of stopping at intermediate positions to allow the stirrup to functions as a kickstand or a shooting rest.

7. In combination with the kit of claim 1, a hybrid compound bow having a shoot through riser and no integral handgrip in the riser area.

8. The combination of claim 7, the bow further comprising a contained arrow rest positioned in the shoot through riser to give a nocked arrow essentially vertical and horizontal centering on the bow.

9. A kit for converting a compound archery bow into a vertical limb crossbow, the kit comprising:

a drawlock bar configured as a hollow tube with square cross section, the bar having a series of bolt holes spaced along left and right lateral sides its length, the bar also having one end adapted to be inserted into a socket attached to a side of the riser section of a compound bow, and a trigger and string release assembly adapted to be bolted to the bar through at least a pair of the bolt holes, the trigger and release assembly including a string release section containing a string latch, and a trigger section containing a pistol grip and a trigger for actuating the string latch to release the string.

10. A kit as in claim 9, further comprising a mounting plate for attaching said socket to the bow, wherein the mounting plate has a bolt hole and a bolt slot for bolting the socket to the bow at an adjustable angle to offset the bar so that the bar does not interfere with the drawstring.

11. A kit as in claim 9, wherein the draw-lock bar can be mounted either side of the bow, the trigger and string release assembly can be mounted on the inside of the bar when the bar is either on the left or right side of the bow, and the trigger and pistol grip can be individually relocated within the trigger section for right or left hand shooting.

* * * * *